US006336981B2

(12) United States Patent
Espagnacq et al.

(10) Patent No.: US 6,336,981 B2
(45) **Date of Patent: *Jan. 8, 2002**

(54) PROCESS TO MANUFACTURE AN OBJECT USING A GRANULAR MATERIAL IGNITER TUBE AND PROPELLANT CHARGE OBTAINED USING SUCH A PROCESS

(75) Inventors: André Espagnacq, Bourges; Nicole Forichon-Chaumet, Plaimpied; Tony Rodriguez, Bourges, all of (FR)

(73) Assignee: Giat Industries (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/280,700

(22) Filed: Mar. 30, 1999

(30) Foreign Application Priority Data

Mar. 30, 1998 (FR) ..... 98 04021

(51) Int. Cl.[7] ..... C06B 45/10; C06B 21/00; D03D 23/00

(52) U.S. Cl. ..... 149/19.92; 149/109.6; 86/1.1

(58) Field of Search ..... 149/19.1, 19.92, 149/109.6; 102/275.6, 283, 289, 291; 86/1.1, 10, 20.12

(56) References Cited

U.S. PATENT DOCUMENTS

| | | | | |
|---|---|---|---|---|
| 3,062,147 | A | 11/1962 | Davis et al. | 102/70 |
| 3,205,286 | A | 9/1965 | Black | 264/3 |
| 3,529,551 | A | 9/1970 | Barbero et al. | 102/101 |
| 3,537,923 | A | 11/1970 | Gould et al. | 149/22 |
| 3,926,697 | A | 12/1975 | Humbert et al. | 149/14 |
| 4,886,560 | A | 12/1989 | Cartwright | 149/12 |
| 5,453,236 | A | 9/1995 | Daly | 264/128 |

FOREIGN PATENT DOCUMENTS

| | | |
|---|---|---|
| EP | 0728632 | 8/1996 |
| GB | 888858 | 2/1962 |
| GB | 1231181 | 5/1971 |

*Primary Examiner*—Charles T. Jordan
*Assistant Examiner*—Aileen J. Baker
(74) *Attorney, Agent, or Firm*—Parkhurst & Wendel, L.L.P

(57) ABSTRACT

The invention relates to a process to manufacture an object using at least one granular material (16) having a large particle size, for example greater than or equal to 0.1 mm, such process being characterised by the following stages:

Figure 1:
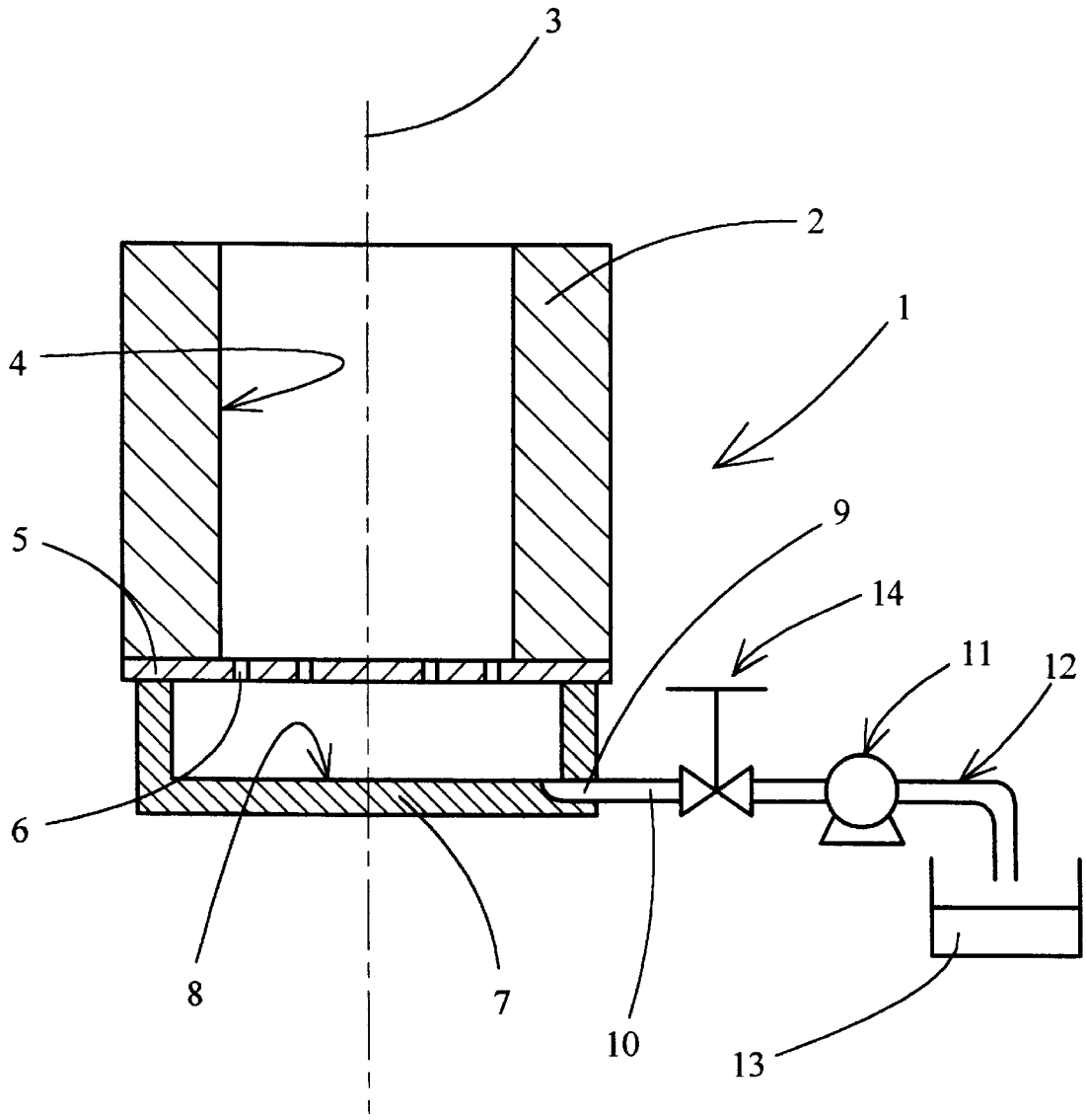

the granular material or materials are placed in a mould (2) at the same dimensions as the object to be made and incorporating at least one evacuation opening (6), said opening being of a size that is less than the particle size of the material, a liquid-phase binder (21) is poured into the mould, the binder is mixed between the grains of material and the excess binder is drained off through the evacuation opening using suction means (11).

Application in the manufacture of igniting tubes or propellant charges for artillery ammunition.

15 Claims, 6 Drawing Sheets

PROCESS TO MANUFACTURE AN OBJECT USING A GRANULAR MATERIAL IGNITER TUBE AND PROPELLANT CHARGE OBTAINED USING SUCH A PROCESS

The technical scope of the invention is that of processes to manufacture objects using a granular material and notably processes to manufacture objects using energetic materials.

It is known by patent EP754927 to manufacture an igniter tube for an artillery propellant charge incorporating several layers of black powder of a high particle size (greater than or equal to 0.1 mm) agglomerated using a binder.

This document also discloses a process to manufacture such an igniter tube, process in which a layer of binder such as collodion is deposited on the inside wall of a tubular support, thereafter, grains of black powder are spread over this binder so as to form a first layer. The operations of depositing binder and then black powder are reiterated so as to form the desired tube.

This process presents the drawback of being too slow to allow manufacture on an industrial scale. Moreover, it does not allow the thickness of black powder deposit, and therefore the igniting properties of the igniter tube, to be sufficiently regulated. Lastly, the mechanical characteristics of said igniter tube are insufficient and the use of a tubular support is mandatory even though it risks interfering with the combustion of the igniter.

A process is notably also known, by patents GB888858 and U.S. Pat. No. 3,926,697, to manufacture propellant grains for rockets or missiles, process in which the propellant powder is placed in a mould after which a binder is introduced under pressure into the lower part of the mould.

The binder moves up to the upper part of the mould and coats the grains of powder without allowing air bubbles or porosities to remain.

This process is well adapted to the manufacture of propellant grains for which it is indispensable to avoid porosities that cause random modification in the combustion rate and thus disturbances to the propellant performances or even a change in rate likely to lead to the detonation of the load.

It is, however, ill-adapted to the manufacture of an igniter tube since for such a component a certain porosity is sought after that enables the radial diffusion of the flame produced by the igniter tube to be made easier.

Moreover, using such a process, the compression of the grains of pyrotechnic composition risks causing said grains to fracture, settling or even granulometric segregation along the height of the mould thereby leading to downgraded igniting performances and a reduction in reliability. Lastly, an igniting charge is known, notably by patent WO8601584, that is formed by a stack of ring-shaped pellets of compressed black powder. Each pellet is made by compression thereby imposing the use of a powder having a low particle size (less than 0.1 mm) so as to obtain the right cohesion and mechanical strength. All the same, to be effective, an igniting signal must have a sufficiently long application time. However, we know that when the igniting composition has settled or is compressed, the reaction is intense but for a duration that is too short, thereby reducing the effectiveness of such an igniter.

Moreover, the density of the ring shaped pellets is too high thereby leading to the obligation to provide braces of a combustible material between the pellets to respect a ratio of functional mass between the igniting charge and the propellant charge.

An artillery propellant charge is also known, by patent EP306616, formed by a combustible casing inside which a loose powder load has been placed. The charge is ignited by an extruded igniter tube formed by a tube of an energetic composition bonded to a support tube.

The disadvantage of loose loads is that the porosity of the propellant charge is not spread homogeneously. Pressure waves can arise in the weapon chamber as a result disturbing the interior ballistics of the projectile. Moreover, the structure of such a propellant charge module is both complicated and costly to manufacture. Indeed, it requires a combustible casing to be manufactured that also ensures the mechanical strength of the module on the one hand, and the igniter tube on the ocher Then it is necessary to ensure the assembly of the casing and tube as well as that of the powder load.

Agglomerated propellant charges are also known in which the powder grains are coated with a binder and then compressed to ensure the solidity of the load. Such a process to manufacture a load does not enable the porosity of the load obtained to be regulated, moreover, it imposes the establishment of a coating stage for the powder grains thereby complicating the process and increasing its implementation cost.

The aim of the present invention is to propose a process to manufacture an igniter tube or propellant charge that does not suffer from such drawbacks.

The process according to the invention also enables all types of objects made of granular material to be manufactured both quickly and easily, whether said material is energetic or inert.

The process according to the invention notably allows the low cost manufacture of a propellant charge module or a unit of energetic material (for example gas-generating) whose porosity is uniform and evenly distributed. This module can advantageously and using the process according to the invention also incorporate an igniter tube integral with the propellant or energetic unit.

The process according to the invention is particularly economical since it implements neither baking nor compression. It enables objects to be obtained having complicated shapes, even without rotational symmetry, objects that can incorporate inserts and/or associate several layers of materials of a different nature.

The process according to the invention also allows, at equivalent igniting performances, savings in the raw materials used to make the igniter tube. In addition to the resulting reduction in cost, such a saving also enables a reduction of the fouling of the weapon barrels.

A further aim of the invention is to propose an igniter tube and a propellant charge made using the process according to the invention, both tube and charge being easy to manufacture on an industrial scale whilst procuring (notably for the igniting tube) improved igniting properties with respect to known tubes.

Thus, the subject of the invention is a process to manufacture an object using at least one granular material having a large particle size, for example greater than or equal to 0.1 mm, such process being characterised by the following stages:

- the granular material or materials are placed in a mould at the same dimensions as the object to be made and incorporating at least one evacuation opening, said opening being of a size that is less than the particle size of the material,
- a liquid-phase binder is poured into the mould,
- the binder is mixed between the grains of material and the excess binder is drained off through the evacuation opening using suction means.

According to an essential characteristic of the invention, the granular material comprises at least one energetic material such as a propellant powder, an explosive, black powder or a pyrotechnic composition.

The binder can be a solid binder dissolved in a solvent.

The solid binder can notably be selected from among the following components: polyvinyl nitrate, nitrocellulose, rubber, polyvinyl chloride or its copolymer, polyvinyl acetate or its copolymer, chlorofluoroethylene copolymer.

The binder can thus be a polymerisable liquid binder in which case, after diffusion of the solvent, the next process will be the polymerising of the binder.

The polymerisable binder can thus be selected from one of the following components: polybutadiene, polyurethane, acrylic resin, polyester resin, epoxy resin.

According to a particular embodiment of the invention, at least one insert can be made in the mould intended to be included in or integral with the object manufactured.

The insert can be formed by a protective film intended to envelope the object.

When the process is implemented using at least one energetic material, at least one insert can be formed by an igniting cord for the energetic material.

According to another particular embodiment of the invention, at least one insert can be formed by another object obtained using the process according to the invention.

According to another embodiment, at least one insert can be formed by a wire passing through the object.

According to a variant of the process according to the invention, at least two different granular materials will be placed in the mould before pouring in the binder.

The different granular materials can be arranged in the form of successive horizontal layers.

The different granular materials can be arranged in the form of successive vertical layers, means being provided to separate the different layers from one another at least temporarily whilst the different materials are being put into the mould.

Advantageously, the mould can be coated with an anti-stick material.

A further subject of the invention is the manufacture of an igniting tube, notably for a piece of artillery ammunition, made using such a process.

This igniting tube can notably incorporate a tubular body formed by stacking at least two ring-shaped layers of pyrotechnic materials of different natures.

In this case and according to a specific embodiment, at least one layer can be formed by a composition combining boron and potassium nitrate and another layer can be formed by a composition combining aluminium and copper oxide (CuO).

More specifically, the igniting tube can be formed by stacking a first ring-shaped layer combining: boron (5% to 35% in weight), potassium nitrate (65% to 95% in weight), nitrocellulose (0.5% to 5% in weight), and a second ring-shaped layer combining: aluminium (5% to 35% in weight), copper oxide (CuO) (65% to 95% in weight).

Or else the first ring-shaped layer can be composed of: boron (19% in weight), potassium nitrate (80% in weight), nitrocellulose (1% in weight), and the second ring-shaped layer can be composed of: aluminum (20% in weight), copper oxide (CuO) (80% in weight).

According to a variant of the two previous embodiments, the igniting tube can incorporate a bird ring-shaped layer combining: boron (65% to 95% in weight), potassium nitrate (5% to 25% in weight), nitrocellulose (1% to 10% in weight)

Or else, the third ring-shaped layer can be composed of; boron (80% in weight), potassium nitrate (14% in weight), nitrocellulose (6% in weight).

According to another embodiment, the igniting tube according to the invention can incorporate a tubular body formed by at least two concentric ring-shaped layers of pyrotechnic materials of different natures.

By way of a specific example, the igniting tube can incorporate an inner layer combining: boron (5% to 35% in weight), potassium nitrate (65% to 95% in weight), nitrocellulose (0.5% to 5% in weight), and an outer layer combining: boron (15% to 35% in weight), potassium nitrate (65% to 85% in weight).

Also by way of example, the igniting tube can incorporate an inner layer combining: boron (19% in weight), potassium nitrate (80% in weight), nitrocellulose (1% in weight), and an outer layer combining: boron (25% it weight), potassium nitrate (75% in weight).

According to another example, the igniting tube incorporates an inner layer combining: boron (5% to 25% in weight), potassium nitrate (65% to 85% in weight), collodion (0.5% to 8% in weight), and an outer layer combining: boron (5% to 25% in weight), potassium nitrate (65% to 85% in weight), polyvinyl chloride (0.5% to 8% in weight).

According to yet another example, the inner layer combines: boron (19% in weight), potassium nitrate (76% in weight), collodion (5% in weight), and the outer layer combines: boron (19% in weight), potassium nitrate (76% in weight), polyvinyl chloride (5% in weight)

According to another embodiment of the invention, the igniting tube can incorporate at least one wire of a pyrotechnic composition extending substantially over its full length.

The pyrotechnic composition of the wire can combine: magnesium (45% to 65% in weight), polytetrafluorethylene (20% to 40% in weight), chlorofluoroethylene copolymer (5% to 25% in weight).

By way of a variant, the pyrotechnic composition of the wire can combine: magnesium (54% in weight), polytetrafluorethylene (30% in weight), chlorofluoroethylene (16% in weight).

A further and final subject of the invention is a propellant charge notably for a piece of ammunition made using such a process.

This propellant charge will, for example, incorporate a tubular body formed by at least two ring-shaped layers of pyrotechnic materials of different natures, an outer layer of agglomerated propellant powder and an inner layer of igniting material.

Figure 2:
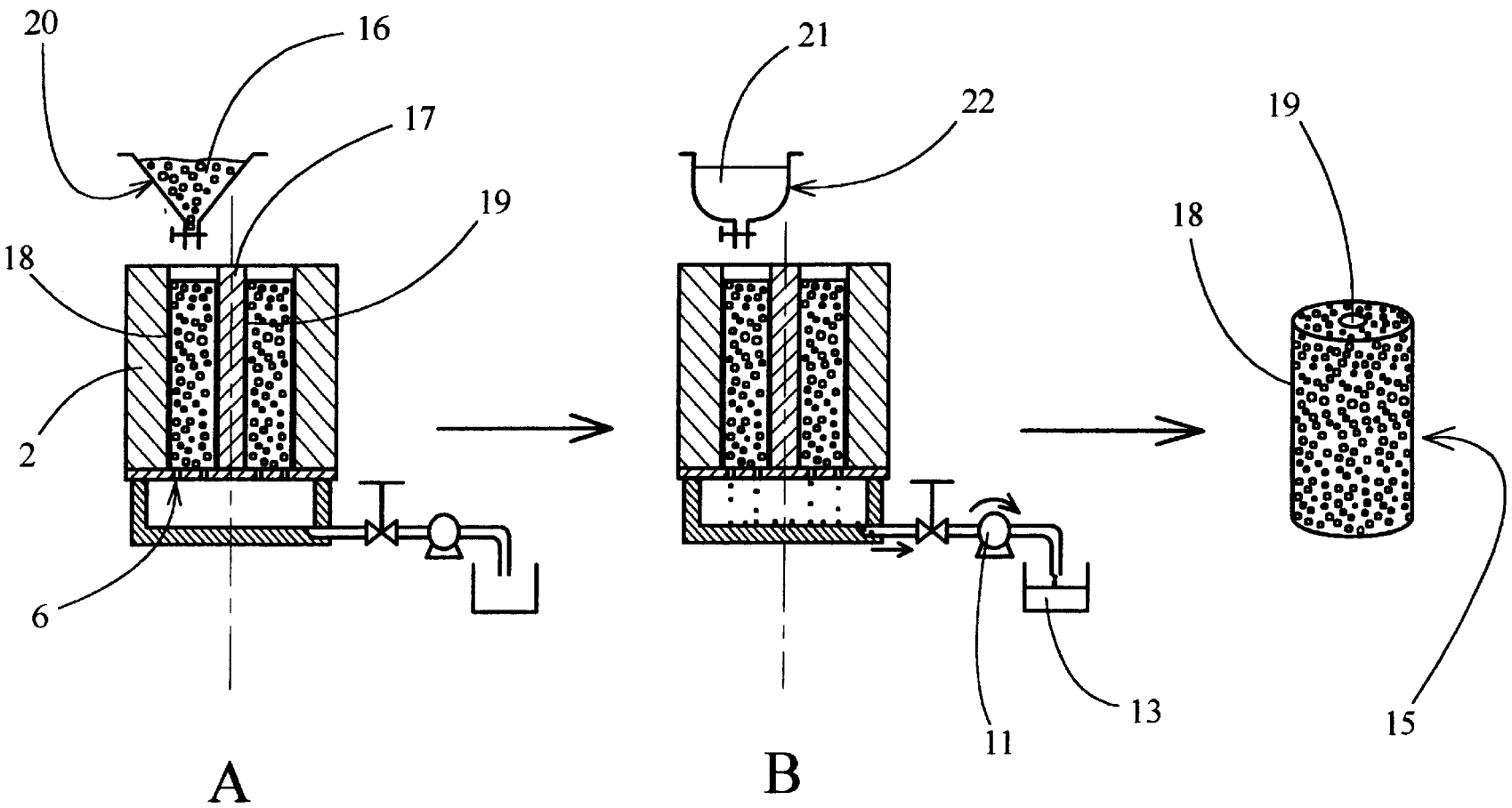
Figure 3:
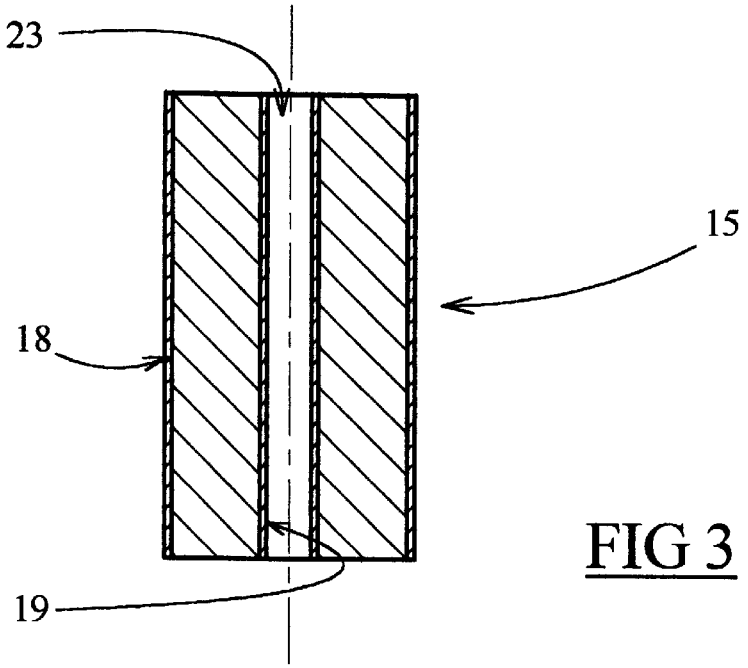
Figure 4:
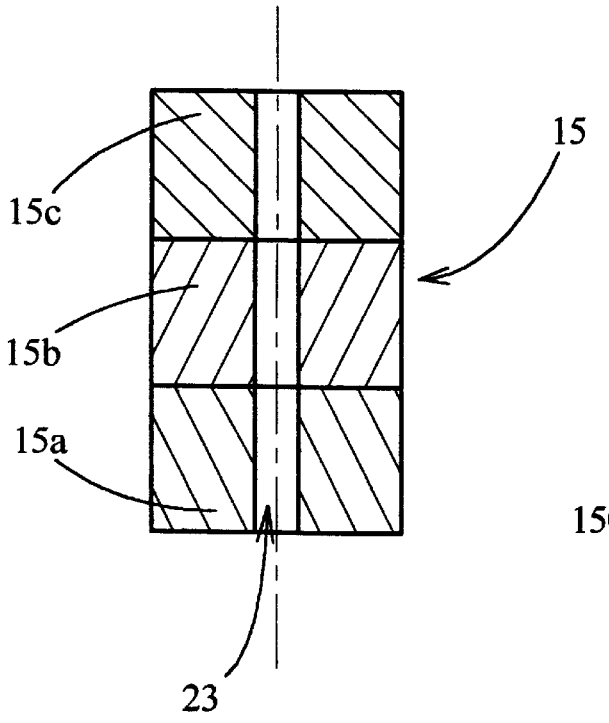
Figure 5:
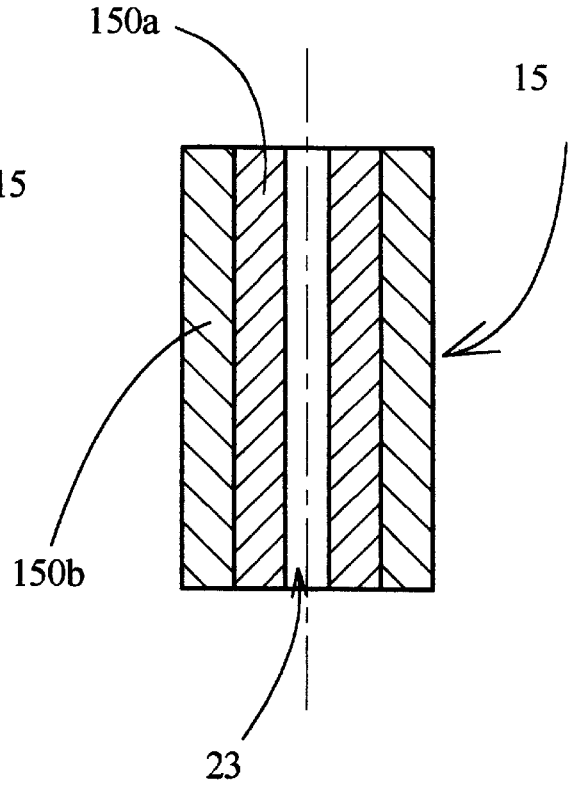
Figure 6:
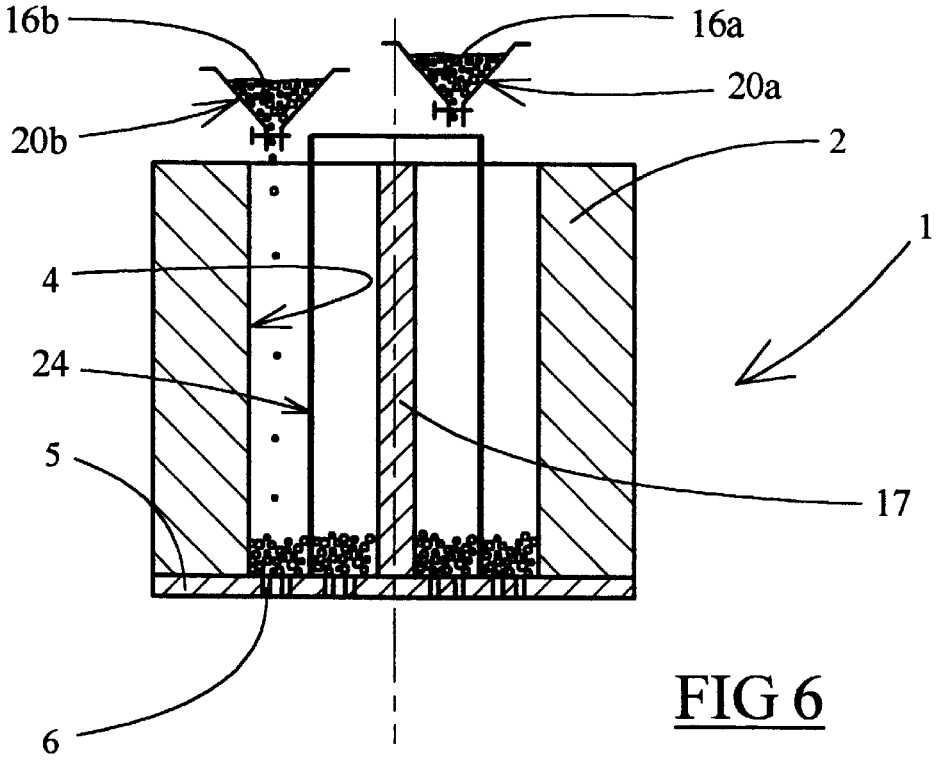
Figure 7:
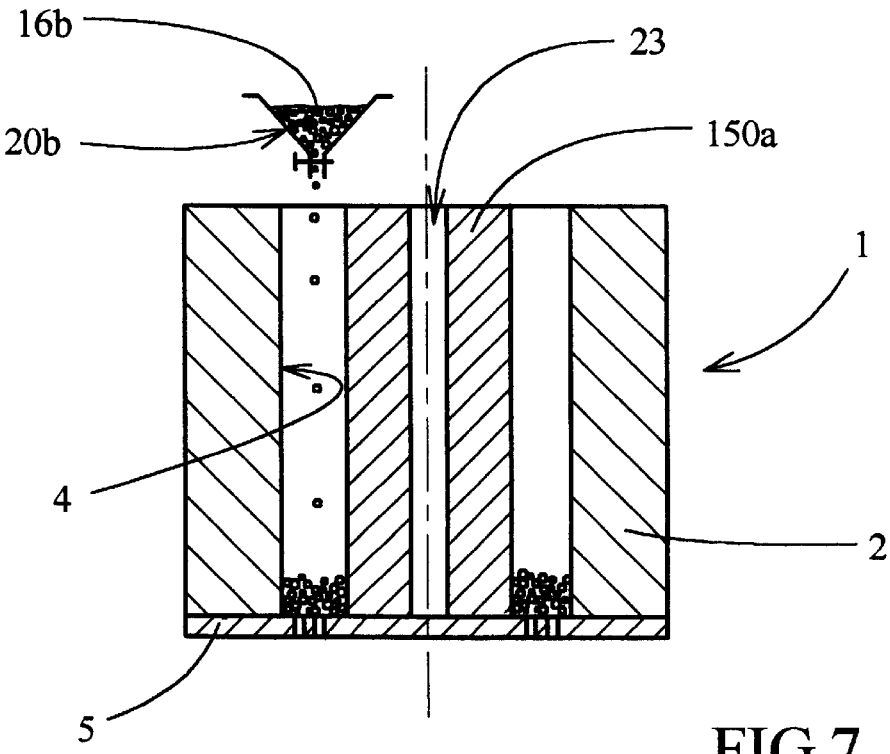
Figure 8:
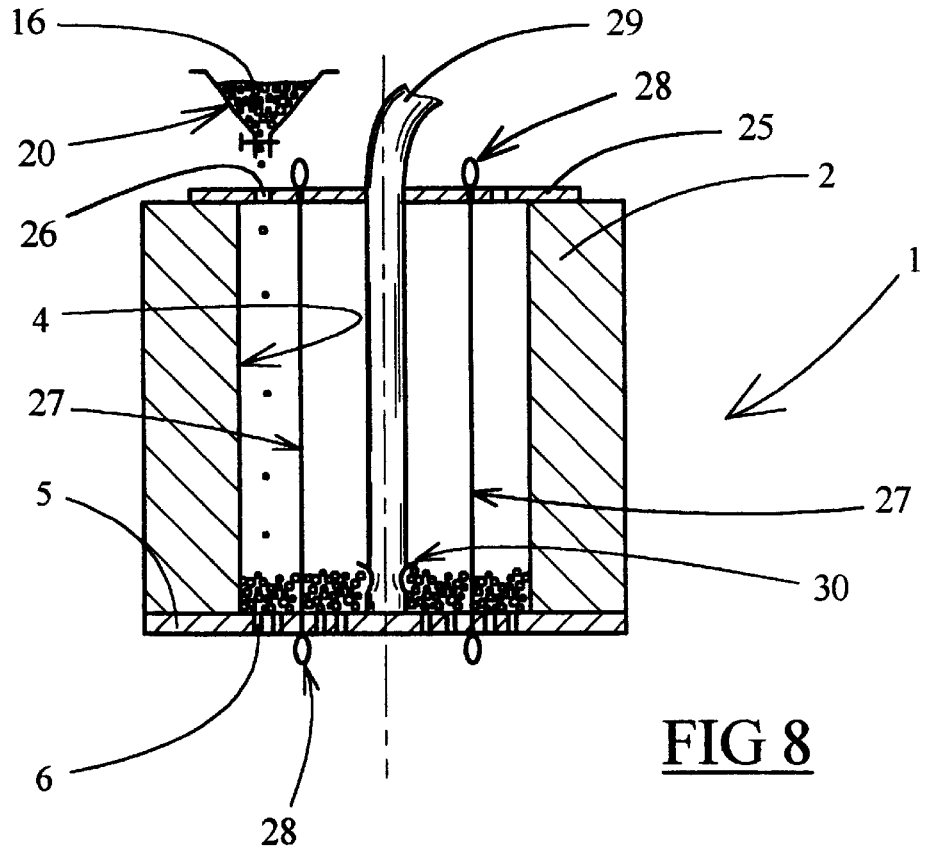
Figure 9:
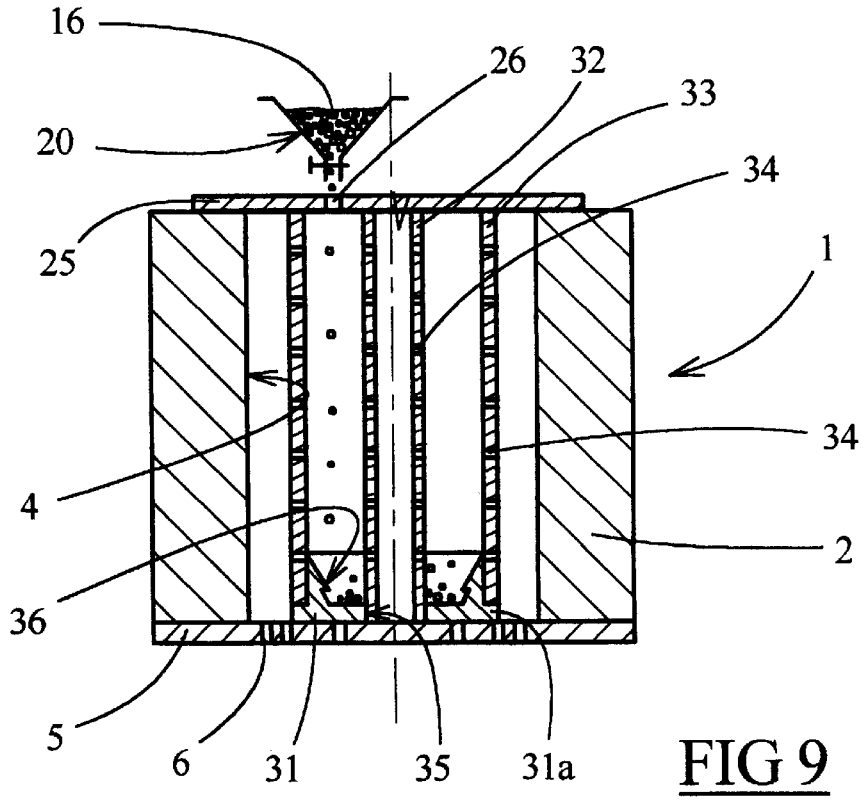
Figure 9A:
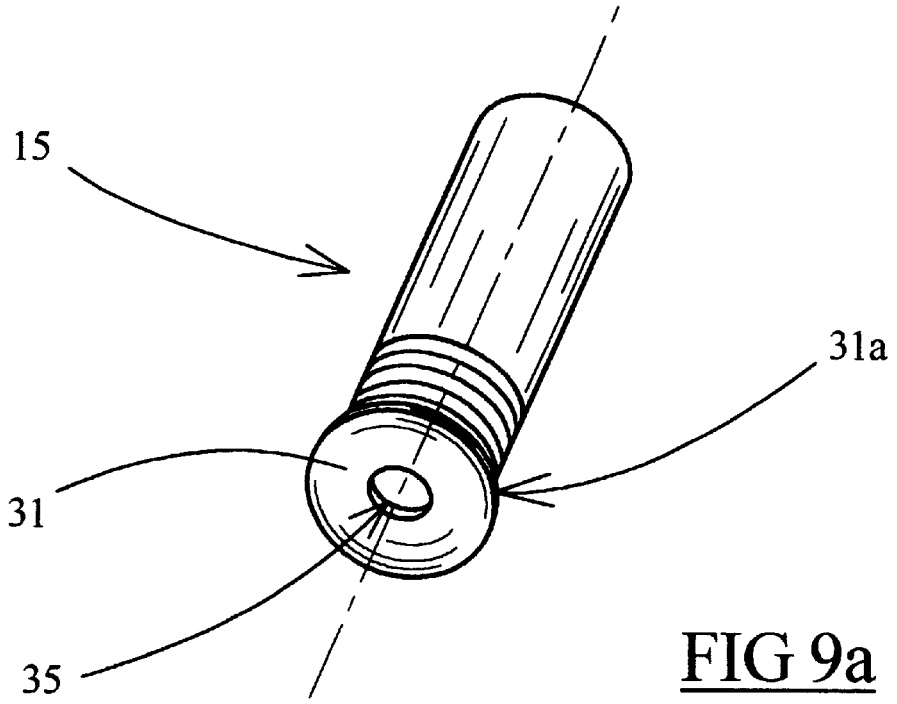

The invention will be better understood after reading the following description made of the different embodiments, such description being made with reference to the appended drawings in which:

FIG. 1 is a schematic section view of tooling implemented with the process according to the invention, FIG. 2 shows several successive stages of the process according to the invention, FIGS. 3, 4 and 5 are longitudinal section views of three embodiments of igniting tubes according to the invention, FIG. 6 is a section view of a first tooling implemented to manufacture the igniting tube according to FIG. 5, FIG. 7 is a section view of a second tooling implemented to manufacture the igniting tube according to FIG. 5, FIG. 8 is a section view of a third tooling enabling the inclusion of inserts, FIG. 9*a* is a section view of a fourth tooling enabling the manufacture of inserts, FIG. 9*b* is a perspective view of an igniting tube made using the tooling in FIG. 9*a,*

Figure 10:
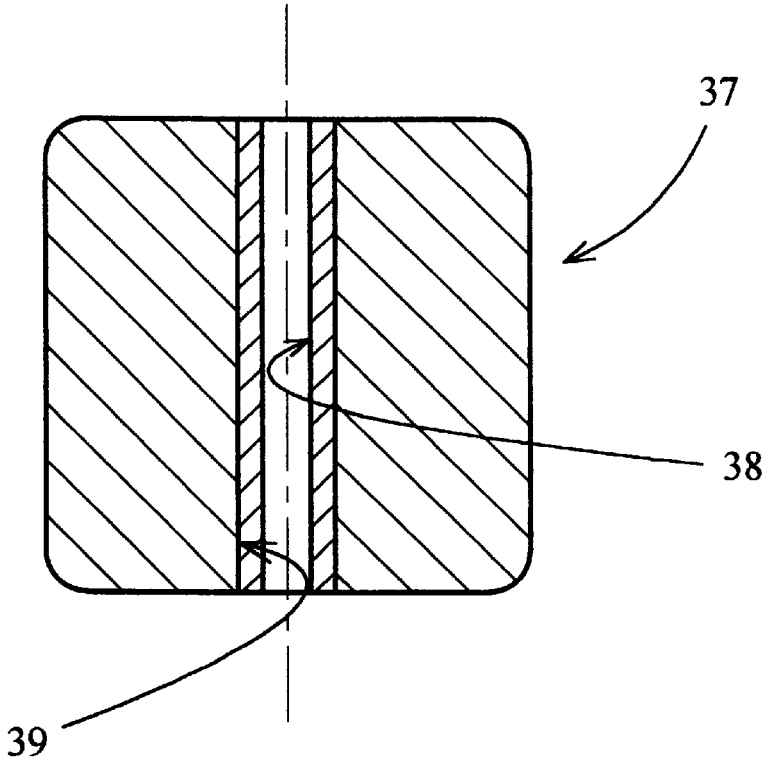

FIG. 10 is a longitudinal section view of a propellant charge according to the invention.

With reference to FIG. 1, a tooling 1 required to implement the process according to the invention comprises a mould 2, delimiting here a substantially cylindrical inner volume with axis 3, and whose inner cylindrical surface 4 is selected to be equal in diameter to that wanted for the object to be manufactured.

The mould is obturated at a lower end by a grating 5, that is here formed by a plate perforated with evenly spaced holes 6.

The holes will be selected of a diameter less than the particle size of a granular material intended to be used in the manufacture of the object.

Mould 2, obturated by grating 5, is arranged on an extractor support 7 incorporating a cavity 8. Sealing means (not shown), such as seals, are arranged between support 7 and mould 8. The mould is fastened to the support by means of straps (not shown).

Inner cavity 8 of support 7 is linked by opening 9 to piping 10, which is itself linked to an extraction means 11 (such as a vacuum pump activated by an electric motor). The lift end 12 of pump 11 is connected to a recovery basin 13. A vane 14 will advantageously be arranged on piping 10 between pump 11 and cavity 7.

Mould 2, grating 5 and support 7 will be made of chemically inert materials with respect to the granular material and will retain good dimensional characteristics despite the stresses generated by evacuation. These elements will, for example, be made of Teflon (trade name for polytetra-fluorethylene), or alternatively steel or polyamide 6-6 (more commonly known by its trade name Nylon) can be used.

To facilitate removal from the mould, said mould (as well as any mould core or mould cores) can be made of an anti-stick material (such as polytetra-fluorethylene or Teflon) or the walls of said mould can be coated with such an anti-stick material. The surface will also be selected sufficiently smooth so as to make removal from the mould easier.

FIG. 2 shows this tooling during the different stages of manufacture of an object 15, which in this case is an igniting tube for a piece of artillery ammunition.

During a first stage A, a granular material 16 is put into mould 2.

In the example described here, mould 2 receives (before the granular material is put in) a cylindrical mould core 17 that is coaxial to mould 2 and made of an anti-stick material (or coated with such a material). Means (not shown), for example retention braces, will ensure the positioning of the mould core coaxial to the inner cylindrical surface 4 of mould 2.

A first cylindrical film 18 having the same diameter as the inner cylindrical surface 4 of the mould and a second cylindrical film 19 hating the same diameter as mould core 17 are placed in the mould. Films 18 and 19 are intended to be made integral respectively with the outer cylindrical surface of tie igniting tube and the inner cylindrical surface of its axial bore. They will ensure a protective role for the igniting tube with respect to humidity.

The granular material will be of a large particle size, for example greater than or equal to 0.1 mm. Indeed, a particle size that is too small is likely to prevent a binder from being diffused between the grains of materials, as will be explained hereafter.

In this case, the material implemented is a black powder of a particle size of between 1.4 and 3.2 mm (PN3). It is poured by hopper 20.

When the mould has been filled up (end of stage A), a liquid-phase binder 21 is poured in the mould (stage B). The binder is distributed by means of a metering hopper 22. Because of the particle size of material 16, binder 21 is evenly distributed by gravity between the grains and humidifies all the granular material placed in the mould as well as the inserts formed by protective films 18 and 19.

At the same time as the binder is being distributed, suction means 11 are activated thereby accelerating the diffusion of the binder through grating 5 and also evacuating the excess binder, which drips through holes 6 and is evacuated towards recovery basin 13.

When the binder being used is a solid binder dissolved in a solvent, this evacuation operation also accelerates the drying of the binder.

For the example described here, the binder used to coat the grains of black powder is a nitrocellulose-based adhesive obtained by dissolving 13 g of nitrocellulose-based powder in 100 cubic centimeters of a suitable solvent (for example, a mixture of 60% by volume of ethyl acetate, 15% by volume of acetone, 10% by volume of ethanol and 15% by volume of butyl acetate).

Using such a process an igniting tube 100 mm long and 24 mm in diameter, incorporating an axial bore of 17 mm, was manufactured. The entire duration of the diffusion and evacuation operations of phase B is of 2 minutes.

After stage B igniting tube 15 is removed from the mould. It is possible to put the igniting tube into an oven to improve drying.

The process according to the invention has enabled a igniting tube 15 of the required final dimensions to be manufactured during these three stages, that incorporates, by using mould core 17, an axial igniting channel 23 (see FIG. 3). The process has also allowed an igniting tube, to be manufactured that incorporates a protective film 18, 19 on each of its cylindrical surfaces; the protective films having been made integral with the tube by means of the binder.

This igniting tube has a certain porosity due to the spontaneous arrangement of the grains when the granular material was put in place. The fact of distributing the binder by gravimetric diffusion and by using suction means, as proposed by the invention, enables the quantity of binder used to be just enough to agglomerate the grains whilst maintaining the natural porosity of the unbound load.

The porosity can be adjusted by selection of the particle size range of the material. Thus, by way of example, for a particle size of between 0.1 and 0.5 mm the porosity is around 40% and for a particle size of between 0.3 and 0.8 mm the porosity is of around 60%.

The porosity can also be modified by combining at least two materials of different particle sizes.

The porosity of the tube obtained in the previous example (ratio of empty volume to full volume) is of around 30 to 50% by volume (around 16 cm3 of empty space for a total volume of 38 cm3).

The black powder igniting tube thus manufactured in the previous example has a density of around 1 g/cm3 (the density of black powder being of 1.76 g/cm3), its porosity is thus around 40%. By way of comparative example, a conventional igniting tube manufactured by stacking rings of compressed black powder has a density of 1.75 g/cm3 (and its porosity is less than 1%).

Comparative firing tests have been carried out on a test bench using an igniting tube obtained using the process according to the invention (described above) and an igniting tube of the same external dimensions and formed by stacking 6 pellets of black powder. We noted:

With a conventional igniting tube of compressed black powder (prior art), the appearance of the pressure build-up signal (at the onset of ignition) occurred 22 milliseconds after ignition of the igniting tube, the maximum pressure appearing 24.55 milliseconds after ignition, in other words a duration of effective ignition of around 2.55 milliseconds.

With an igniting tube according to the invention, the pressure build-up occurs 34 milliseconds after ignition, and the maximum pressure appears 38.28 milliseconds after ignition, in other words an effective ignition duration of around 4.28 milliseconds.

In both cases the ignition is carried out with a temperature of around 1500° C. and a reaction heat of around 450 cal/g. However, with the igniting tube according to the invention, this energy is applied for a period twice as long, resulting in better ignition performances.

Ignition progressivity is much better with the igniter according to the invention and such a result is due to the greater porosity of the igniter obtained using the process according to the invention.

Moreover, the total mass of the igniter according to the invention thus tested is of 38 g whereas that of the compressed black powder igniter is of 51 g. The igniter according to the invention thus ensures better ignition whilst having a lower mass, thereby enabling a reduction in cost, lees fouling of the weapon barrel, and reduced pyrotechnic risks during the storage and handling phases by reducing the quantity of active material.

By way of a variant, other types of binders can be used, be they pyrotechnically active or inert.

Liquid binders can be implemented such as (non-exhaustive list): polyurethanes, acrylics, polyesters.

Binders formed of a solid component dissolved in an appropriate solvent, such as (non-exhaustive list): polyvinyl chloride (PVC), polyvinyl acetate (PVA), nitrocellulose or polyvinyl nitrate (NPV).

Certain binders could require a polymerising phase to solidify them (for example polyurethane or epoxy resin). In this case, after the end of phase B and before removal from the move, a reticulation phase will be carried out by heating. The duration and temperature of such a heating phase will be selected by the expert according to the characteristics of the binder used.

The process according to the invention also enables other objects with regulated porosity, apart from igniting tubes, to be manufactured. Mould 2 merely has to be given the external geometric shape required for the object. This shape can, or can not, have rotational symmetry. We can have a mould, for example, whose inner volume has a rectangular section, or a mould whose section varies axially between the upper opening and grating 5.

From an industrial point of view, it is possible for a mould to be designed that has several cylindrical cavities that are parallel to one another thereby enabling several igniting tubes to be manufactured at the same time.

The process according to the invention also enables other types of igniting tubes to be manufactured.

FIG. 4 thus shows an igniting tube 15 that also has a globally cylindrical shape and an axial channel 23. This igniting tube is formed by stacking several ring-shaped layers 15*a*, 15*b* and 15*c* of different compositions.

We can therefore manufacture:

layer 15*a* using a composition combining boron, potassium nitrate and nitrocellulose as a binder (B/KNO3/NC), this composition enables products with a gaseous and condensable reaction to be produced thereby favouring ignition by convection, layers 15*b* using a composition combining aluminium and copper oxide (Al/CuO), such composition enabling products of essentially condensed reaction having a reaction temperature of over 3200° K. to be produced, thereby favouring ignition by radiation, layer 15*c* using a composition combining boron, potassium nitrate and nitrocellulose. This composition enables products of gaseous and condensable reaction to be manufactured, but it will be formulated so as to have a greater reaction opted than that described for layer 15*a*. Such an igniter enables the igniter function to be regulated by delivering products of specific reactions.

This is useful notably in the case of the ignition of composite powders which require complex igniting materials as they are both sensitive to ignition by convection and to ignition by radiation.

The complex igniting tube thus manufactured will there again have porosity characteristics that can be regulated by the process according to the invention.

By way of example, the following compositions can be combined:

1. layer 15*a*

Boron: 5% to 35% in weight (preferably 19%),

Potassium nitrate: 65% to 95% in weight (preferably 80%),

Nitrocellulose: 0.5% to 5% in weight (preferably 1%).

2. Layer 15*b*

Aluminium: 5% to 35% in weight (preferably 20%),

Copper oxide (CuO): 65% to 95% in weight (preferably 80%).

3. Layer 15*c*

Boron: 65% to 95% in weight (preferably 80%),

Potassium nitrate: 5% to 25% in weight (preferably 14%),

Nitrocellulose: 1% to 10% in weight (preferably 6%).

The igniting tube can be easily and inexpensively manufactured using the process according to the invention.

For this, several different hoppers 20 must be provided, each hopper providing the exact quantity of material required to manufacture a single ring-shaped layer.

The granular material is thus poured into the mould (stage A) by several successive pourings so as to form the different layers. The binder is then poured into the would during a single stage B. It ensures that all the grains are humidified whatever their nature thereby enabling the thorough consolidation of all the layers. A complex igniting tube is thereby obtained that has mechanical strength analogous to that of a homogeneous igniting tube.

It is also possible to manufacture an igniting tube formed by stacking two layers: a layers 15*a* and a layer 15*b* using the compositions given previously for these two layers (15*a*: B/KNO3/NC, 15*b*: Al/Cuo)

FIG. 5 shows another type of igniting tube 15 that also has a globally cylindrical shape and an axial channel 23. This igniting tube is formed of two concentric cylindrical layers 150*a* and 150*b* whose compositions are Inner layer 150*a* can thus be made using a boron/potassium nitrate (B/KNO3) composition formulated so as to have a reaction rate of around 15 mm/s. This layer enables a relatively short reaction transmission time to be obtained along the full length of the igniting tube (axial using a B/KNO3 composition formulated so as to have a reaction rate of around 8 mm/s. This layer facilitates the ignition of the propellant charge of a piece of ammunition in the vicinity of its grains (radial ignition).

The following can, for example, be combined:

1. inner layer 150*a*

Boron: 5% to 35% in weight (preferably 19%),

Potassium nitrate: 65% to 95% in weight (preferably 80%),

Nitrocellulose: 0.5% to 5% in weight (preferably 1%).

2. outer layer 150*b*

Boron: 15% to 35% in weight (preferably 25%),

Potassium nitrate 65% to 85% in weight (preferably 75%).

FIG. 6 shows a first tooling enabling such an igniting tube to be manufactured.

To simplify the drawing, the tooling is, in this case, shown configured so as to manufacture an igniting tube that only has two concentric cylindrical layers.

Moreover, suction means 11 and suction support 7 upon which the mould is fastened in a water-tight manner are not shown. These means are identical to those described with reference to FIGS. 1 and 2 to which reference may be made.

Mould 2, as in the embodiment according to FIG. 2, receives an axial mould core 17. A tubular insert screen 24 is placed coaxially to core 17 and to inner cylindrical surface 4 of mould 2. Retention means (not shown), for example braces, will ensure the positioning of core 17 and screen 24 coaxially to cylindrical surface 4.

The purpose of screen 24 is to materialise the separation between the two concentric cylindrical layers of the igniting tube. It will be formed, for example, by a sheet o paper or thin cartonboard (of a few hundredths of mm in thickness).

A first hopper 20*a* will ensure that the ring-shaped space between core 17 and screen 24 is filled up by a first granular material 16*a*.

A second hopper 20*b* will ensure (either simultaneously or not) that the ring-shaped space between screen 24 and cylindrical surface 4 of the mould is filled up by a second granular material 16*b*.

Once the two materials have been put into place in the mould, screen 24 can be removed before proceeding to pour in the binder.

The binder will coat and consolidate all the grains of granular material homogeneously and will ensure at the same time the consolidation of the two ring-shaped layers.

An igniting tube can naturally be made using more than two coaxial cylindrical layers by arranging several concentric screens and by pouring a different granular material into each ring-shaped space thus arranged between two consecutive screens.

By way of a variant, screen 24 can be made using an energetic or combustible material (nitrofilm) that will stay in place between the two layers.

It will in this case be necessary to pour the binder on either side of screen 24 so as to ensure the consolidation of the grains forming each cylindrical layer of the igniting tube. The binder will also make each layer integral with the screen, and by extension will make each layer integral with the others.

This variant ensures greater mechanical properties and notably improves the strength of the tube with respect to shocks.

FIG. 7 shows part of a second tooling enabling an igniting tube according to FIG. 5 to be manufactured.

There again, we have not shown the suction means 11 and the suction support 7 upon which the mould is fastened in a water-tight manner. These means are identical to those described with reference to FIGS. 1 and 2 to which reference may be made.

The tooling implemented in this case includes two moulds, a first one (not shown) intended to make a first ring-shaped layer 150*a* of the igniting tube, and a second one (shown in FIG. 7) enabling a second ring-shaped layer 150*b* to be made around this first layer.

The tooling shown in FIG. 7 is in fact analogous to that described with reference to FIGS. 1 and 2. It differs only in that mould core 17 has been replaced by a ring-shaped cylindrical layer 150*a* of a first granular material agglomerated thanks to the process according to the invention and in another mould (not shown) whose inner cylindrical surface is equal to the external diameter of this first layer.

The second granular material 16*b* is poured by hopper 20*b* into the ring-shaped volume separating layer 150*a* and cylindrical surface 4 of the second mould.

Once this volume has been filled, the binder is put into place, such binder will ensure both the consolidation of the grains of granular material and the consolidation between the second ring-shaped layer 150*b* thus formed and the first ring-shaped layer 150*a*.

Once again, the igniting tube thus made will have porosity characteristics that can be regulated by the process according to the invention.

The same binder can be used to manufacture each ring-shaped layer of this igniting tube.

A specific binder can also be used for each of the layers.

An external layer combining boron, potassium nitrate agglomerated using an inert binder such as polyvinyl chloride can be made, for example. An inner layer combining boron, potassium nitrate agglomerated by a collodion will be made. The advantage of this variant lies once again in its ability to confer a quicker axial propagation rate for the ignition at the central part of the tube, the peripheral layer having a slower rate enabling the radial ignition of the propellant charge of the munition.

We will combine, for example:

1. outer layer

Boron; 5% to 25% in weight (preferably 19%),

Potassium nitrate: 65% to 85% in weight (preferably 76%),

Polyvinyl chloride (PVC): 0.5% to 8% in weight (preferably 5%).

2. inner layer

Boron: 5% to 25% in weight (preferably 19%),

Potassium nitrate; 65% to 85% in weight (preferably 76%),

Collodion: 0.5% to 8% in weight (preferably 5%)

It is naturally possible to reiterate the operation using one or several moulds of appropriate dimensions to make an igniting tube having more than two coaxial cylindrical layers.

A further advantage of the process according to the invention is that it enables objects of different shapes and comprising inserts to be manufactured.

We have seen previously that it is thus possible during manufacture to make one or several protective films integral with the igniting tube manufactured (FIGS. 2 and 3), or else to embed a screen 24 between two layers of granular material.

FIG. 8 shows a third tooling arranged to allow other types of inserts to be incorporated in an igniting tube.

Mould 2 is still obturated at its lower part by a grating formed of a plate 5 perforated with holes 6.

There again, suction means 11 and suction support 7 on which the mould is fastened in a water-tight manner are not shown. These means are identical to those described with reference to FIGS. 1 and 2 to which reference may be made.

The mould is also closed off at its upper part by a lid 25, fastened to mould 2 by means (not shown), and carrying a filling orifice 26 intended to provide a passage for granular material 16.

Pyrotechnic composition wires 27 are drawn between lid 25 and plate 5. They are evenly spaced angularly around the axis of cylindrical surface 4 of mould 2.

These wires pass through lid and plate by the orifices and are immobilised in translation by appropriate means, for example locking screws 28 screwed into the lid or the plate each pinching a wire.

The wires will, for example, by wires of a composition combining magnesium, polytetrafluorethylene (known under the trade name Teflon), chlorofluoroethylene copolymer (known under the trade name Viton). Five 2 mm-diameter wires can be placed around a crown.

The wires can be made from the following composition:

Magnesium 45% to 65% in weight (preferably 54%),

Polytetrafluorethylene: 20% to 40% in weight (preferably 30%),

Chlorofluoroethylene copolymer: 5% to 25% in weight (preferably 16%).

Using the tooling made here, lid 25 also holds an igniting cord 29 such as a deflagrating cord one end of which is fastened to grating 5 by appropriate means, for example, clipping onto a clip 30 carried on grating 5.

The igniting cord is thus coaxial to cylindrical surface 4 of mould 2 and extends longitudinally over the full height of the mould.

To implement the tooling according to FIG. 8, lid 25 and grating 5 carrying wires 27 and cord 29 are firstly fastened to mould 2. Thereafter, granular material 16 is put into place through orifice 26. Lastly, when the mould is full, a binder is poured in that will consolidate the different grains of granular material as well as inserts 27 and 29.

Before removing from the mould, the retention screws are unscrewed from the wires and these are shortened if necessary so that they do not project from the igniting tube thus manufactured.

The purpose of the wires is to relay the ignition within the material The purpose of these wires is thus different from that of known wires which are inserted into blocks of propellant charge (see for example patents U.S. Pat. No. 3,205,286 and FR2640259). The purpose of known wires is to modify the propagation rate of the combustion front of the block and thus to regulate the combustion rate of the latter.

With the igniting tube according to the invention, the wire is made of an igniting material and it enables the ignition reaction to be relayed both radially and axially. Better igniting performances are thus ensured whatever the dimensions (axial and radial) of the igniting tube.

In particular, the igniting tube described previously enables multipoint ignition of the material of the igniting tube from a single axial ignition given, for example, by igniting cord 29. Such cord can be a bought component, for example, an ITLX cord (registered trade mark).

FIG. 9*a* shows a fourth tooling that is more particularly adapted to the manufacturing of an igniting tube 15 (see FIG. 9*b*) carrying at its lower part a threaded fastening ring 31, for example metallic, and enabling the mounting of the igniting tube onto an artillery munition base (not shown) to be made easier.

Mould 2 carries a lid 25 fastened to its upper part and a grating 5 connected to its lower part. Sealing means (not shown) are placed between lid and mould.

This tooling incorporates a cylindrical inner casing 32 and an outer casing 33 that is also cylindrical and coaxial to the inner casing. Both casings are held coaxially to one another by means (not shown), for example braces integral with lid 25 of the mould and/or grating 5.

Casings 32 and 33 are perforated with radial holes 34 whose diameter is less than the particle size of the granular material that must be implemented.

Outer casing 33 has an inner diameter equal to that of the outer diameter required for the igniting tube and which is also the outer diameter of treaded ring 31.

Threaded ring 31 is positioned in mould 2 before the granular material in put into place. It rests on grating 5 and has a circular collar 31*a* to which the end of casing 33 is applied.

The threaded ring is pierced with an axial bore 35 that is equal in diameter to the outer diameter of inner casing 32.

Lastly, ring 31 has an inner radial rib 36 that is intended to allow the ring to be made integral with the material of the igniting tube.

Granular material 16 is put into place by means of hopper 20 through orifice 26 in the ring-shaped space separating casings 32 and 33. A binder is then poured into this same space.

As ring 31 occupies the bottom of the ring-shaped space, it blocks holes 6 of grating 5 which lies at the bottom of this space.

The suction means are not shown here but are connected as for FIGS. 1 and 2 to a support on which the mould is positioned in a water-tight manner.

Thanks to holes 6 of grating 5, the suction means create a partial vacuum in the ring-shaped space separating the outer surface of casing 33 and cylindrical surface 4 of mould 2. They also create a partial vacuum in the inner axial cavity of casing 32.

Thus, the excess binder is eliminated via radial holes 34 passing through each casing.

By way of a variant, outer casing 33 can be replaced by cylindrical wall 4 of mould 2. This wall may, or may not, be perforated with holes to evacuate the binder.

If cylindrical wall 4 of the mould is not perforated, the evacuation of the binder will be carried out simply through inner casing 32.

If cylindrical wall 4 of the mould is perforated with holes to evacuate the binder, the mould is enclosed in a sleeve enabling the suction made by the partial vacuum pump 1 to be exerted along the outer surface of the mould. In this case, inner casing 32 can be replaced by a solid core, the evacuation of the binder only being carried out through cylindrical wall 4.

It is naturally possible for the previously described toolings to be combined in order to make an igniting tube that comprises a threaded fastening ring as well as several layers (stacked ring-shaped ones or concentric cylindrical ones) of granular material of different natures.

It is also possible for longitudinal wires or an igniting cord to be inserted on a tube formed of several layers.

FIG. 10 shows another type of object that can be made using the process according to the invention. This object is a propellant charge module 37 for a piece of artillery ammunition.

The module conventionally incorporates an axial igniting channel 38. It is formed of two layers of granular material of different natures agglomerated by means of a binder (for example polyvinyl nitrate or any other binder described with reference to the previous examples). An inner layer 39 of an igniting composition, for example of black powder, and an outer layer of propellant charge, for example a B or GB powder.

The inner layer can advantageously by made alone using a mould of appropriate dimensions (such as that in FIG. 2). Then this layer can be positioned in place of a core inside another mould (such as that in FIG. 7) to make the full propellant charge module.

Thanks to the invention, the porosity distribution of the module is regulated and its mechanical strength is ensured even in the absence of an outer case. This results in better reproducibility of the ballistic performances at a lower cost. Moreover, the process according to the invention enables the igniting tube to be made integral with the propellant charge in a simple manner.

The porosity of the load can be adjusted by modifying the arrangement of the grains of propellant powder. A less porous load can thus be produced by placing a bundle of powder sticks in the mould instead of loose grains. A less porous load can also be achieved by combining at least two types of different particle sizes of powder grains.

An igniting tube according to the invention can also be integrated axially inside a propellant charge of a container for a propellant charge such as is known in prior art (loose powder in a cylindrical combustible case).

The igniting tube according to the invention thereby ensures better ignition since it enables all barriers to be removed (such as known combustible cases) between the igniting composition and propellant powder.

The invention can also be implemented to manufacture other types of objects (whether energetic or not) for which the aim is to regulate porosity distribution, for example blocks of gas-generating composition be they integral with their igniting compositions or not.

What is claimed is:

1. A process for manufacturing a porous object with regulated porosity containing at least one granular material having a particle size of at least 0.1 mm, said process comprising placing said at least one granular material into a mold having (1) dimensions that are the same as the object to be manufactured and (2) at least one evacuation opening of a size less than the particle size of said at least one granular material, said at least one evacuation opening located at the bottom of the mold;

pouring a liquid-phase binder into the mold at the top of the mold;

distributing evenly said binder by gravity between the grains of said at least one material; and while said binder is being distributed, draining off excess binder through the evacuation opening using suction means to accelerate distribution of said binder and to form said porous object.

2. A process according to claim 1, characterised in that the granular material comprises at least one energetic material such as a propellant powder, an explosive, black powder or a pyrotechnic composition.

3. A process according to claim 1, characterised in that the binder is a solid binder dissolved in a solvent.

4. A process according to claim 3, characterised in that the binder is selected from among the following components:

polyvinyl nitrate, nitrocellulose, rubber, polyvinyl chloride or its copolymer, polyvinyl acetate or its copolymer, chlorofluoroethylene copolymer.

5. A process according to claim 1, characterised in that the binder is a polymerisable liquid-phase binder and in that, after diffusion of the liquid phase, the next process is the polymerising of the binder.

6. A process according to claim 5, characterised in that the binder is selected from one of the following components:

polybutadiene, polyurethane, acrylic resin, polyester resin, epoxy resin.

7. A process according to claim 1, characterised in that at least one insert is made in the mold intended to be included in or integral with the object manufactured.

8. A process according to claim 7, characterised in that at least one insert is formed by a protective film intended to envelope the object.

9. A process according to claim 7 and implemented using at least one energetic material, characterised in that at least one insert is formed by an igniting cord for the energetic material.

10. A process according to claim 7, characterised in that at least one insert is formed by another object, thereby obtaining at least two inserts using the process, wherein each insert has a difference porosity.

11. A process according to claim 7, characterised in that at least one insert is formed by a wire passing through the object.

12. A process according to claim 1, characterised in that at least two different granular materials are placed in the mold before pouring in the binder.

13. A process according to claim 12, characterised in that the different granular materials are arranged in the form of successive horizontal layers.

14. A process according to claim 12, characterised in that the different granular materials are arranged in the form of successive vertical layers, means being provided to separate the different layers from one another at least temporarily while the different materials are being put into the mold.

15. A process according to claim 1, characterised in that the mold is coated with an anti-stick material.

* * * * *